United States Patent [19]

Leach et al.

[11] Patent Number: 4,784,224

[45] Date of Patent: Nov. 15, 1988

[54] CASING GUIDE FOR WELL TEMPLATE

[75] Inventors: Colin P. Leach; Charles N. White, both of Houston, Tex.

[73] Assignee: Conoco Inc., Ponca City, Okla.

[21] Appl. No.: 127,351

[22] Filed: Nov. 30, 1987

Related U.S. Application Data

[63] Continuation-in-part of Ser. No. 917,763, Oct. 10, 1986, abandoned.

[51] Int. Cl.[4] ..... E21B 43/01

[52] U.S. Cl. ..... 166/339; 166/85; 166/366; 166/379; 405/224

[58] Field of Search ..... 166/339, 338, 366, 348, 166/344, 345, 341, 342, 75.1, 85, 365, 351, 379, 381; 175/7; 405/224, 227, 226; 285/3, 23, 24, 27, 302, 920

[56] References Cited

U.S. PATENT DOCUMENTS

| | | | |
|---|---|---|---|
| 3,335,799 | 8/1967 | Miller | 285/920 X |
| 3,380,520 | 4/1968 | Pease | 166/366 X |
| 3,618,661 | 11/1971 | Peterman | 166/366 X |
| 3,721,292 | 3/1973 | Ahlstone | 166/359 |
| 4,109,478 | 8/1978 | Gracia | 166/366 X |
| 4,436,152 | 3/1984 | Fisher et al. | 166/214 |
| 4,460,047 | 7/1984 | Pokladnik | 166/341 |
| 4,519,633 | 5/1985 | Nichols | 285/3 |
| 4,674,920 | 6/1987 | Regan et al. | 405/227 |

*Primary Examiner*—Hoang C. Dang

*Attorney, Agent, or Firm*—Richard K. Thomson

[57] ABSTRACT

A casing guide apparatus includes a subsea well template having a well opening defined therein, and a cylindrical well casing received through the well opening. A casing guide bushing is operably asssociated with the template and the casing for permitting relative vertical movement between the template and the casing and for preventing relative lateral movement between the template and the casing at the well opening.

14 Claims, 5 Drawing Sheets

CASING GUIDE FOR WELL TEMPLATE

This is a continuation of application Ser. No. 917,763 filed in-part Oct. 10, 1986 now abandoned.

FIELD OF THE INVENTION

This invention relates generally to offshore hydrocarbon production, and more particularly, to a casing guide apparatus for connecting a well casing to a subsea well gravity base template.

BACKGROUND OF THE INVENTION

With the gradual depletion of subterranean and shallow subsea hydrocarbon reservoirs, the search for additional petroleum reserves is being extended to deeper and deeper waters on the outer continential shelves of the world. As such deeper reservoirs are discovered, increasingly complex and sophisticated production systems have been developed. It is projected that in the near future, offshore exploration and production facilities will be required for probing depths of 10,000 feet or more. Since bottom founded compression structures are generally limited to water depths of no more than about 1,200–1,500 feet because of the sheer size of structure required, other, so-called compliant structures have been developed.

One type of compliant structure receiving considerable attention is a tension leg platform (TLP). A TLP comprises a semisubmersible-type floating platform anchored to the sea bed through vertical members or mooring lines called tension legs. The tension legs are maintained in tension at all times by insuring that the buoyancy of the TLP exceeds its operating weight under all environmental conditions. A TLP is compliantly restrained in the lateral directions allowing sway, surge and yaw while vertical plane movements such as heave, pitch and roll are stiffly restrained by the tension legs.

In the first commercially installed TLP built for the Hutton Field in the U.K. North Sea, installed in 485 feet of water, separate piled anchor templates were provided for anchoring the tensioned mooring elements extending from each of the four corner columns of the floating tension leg platform. A separate well template was also provided on the sea bed.

It has also been proposed to utilize a gravity base well template for the anchoring of a TLP and to serve as a guide template for wells located below the TLP. A gravity base well template is a massive structure which is held in place on the sea floor by gravity, rather than by anchored pilings.

One feature of a gravity base subsea well template which must be accommodated, however, is the tendency of such a massive gravity structure to gradually settle downward in the ocean floor throughout the operating life of the gravity base well template.

SUMMARY OF THE INVENTION

The present invention provides a casing guide particularly designed for use with a gravity base well template to permit the gravity base well template to settle downward relative to the casing extending upward from the well, while at the same time providing firm lateral support to the casing where it passes through the well template.

The casing guide includes a bushing means, operatively associated with the template and the casing, for permitting relative vertical movement between the template and the casing and for preventing relative lateral movement between the template and the casing at a well opening defined through the template. This permits the gravity base template to settle into the ocean floor relative to the casing without imposing substantial compressive loads on the upper portion of the casing, thus eliminating a danger of buckling of the upper portion of the casing upon settling of the gravity based template.

The bushing means includes a cylindrical bushing member having a cylindrical inner bushing bore within which the casing is closely received. The bushing means also includes a latch means, operatively associated with the bushing member and the well opening of the template, for latching the bushing member into a fixed position within the well opening upon insertion of the casing and bushing means downwardly into the well opening of the template.

Numerous objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

Figure 1:
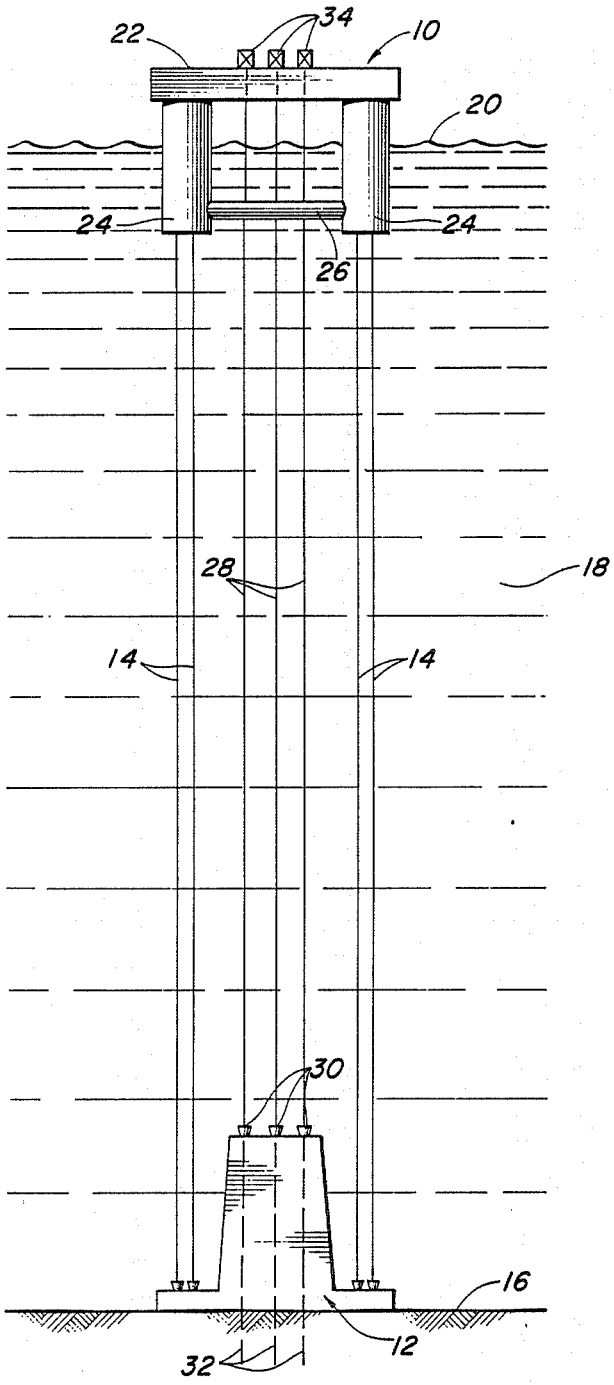
FIG. 1 is a schematic elevation view of a TLP anchored to a gravity base well template.

Referring now to the drawings, and particularly to FIG. 1, a tension leg platform 10 is anchored to a gravity base well template 12 by a plurality of tethers 14.

The gravity base well template 12 sits on an ocean floor 16 defining the bottom of a body of water 18. The TLP 10 floats on the surface 20 of the body of water 18.

The TLP includes a work deck 22 supported on four corner columns 24 which are connected by horizontal pontoon members 26.

A plurality of production risers 28 extend from subsea well heads 30 defined on the upper end of well casings 32. Each of the production risers 28 terminates in a well head apparatus 34 commonly referred to as a Christmas tree 34 located upon the work deck 22.

Figure 2:
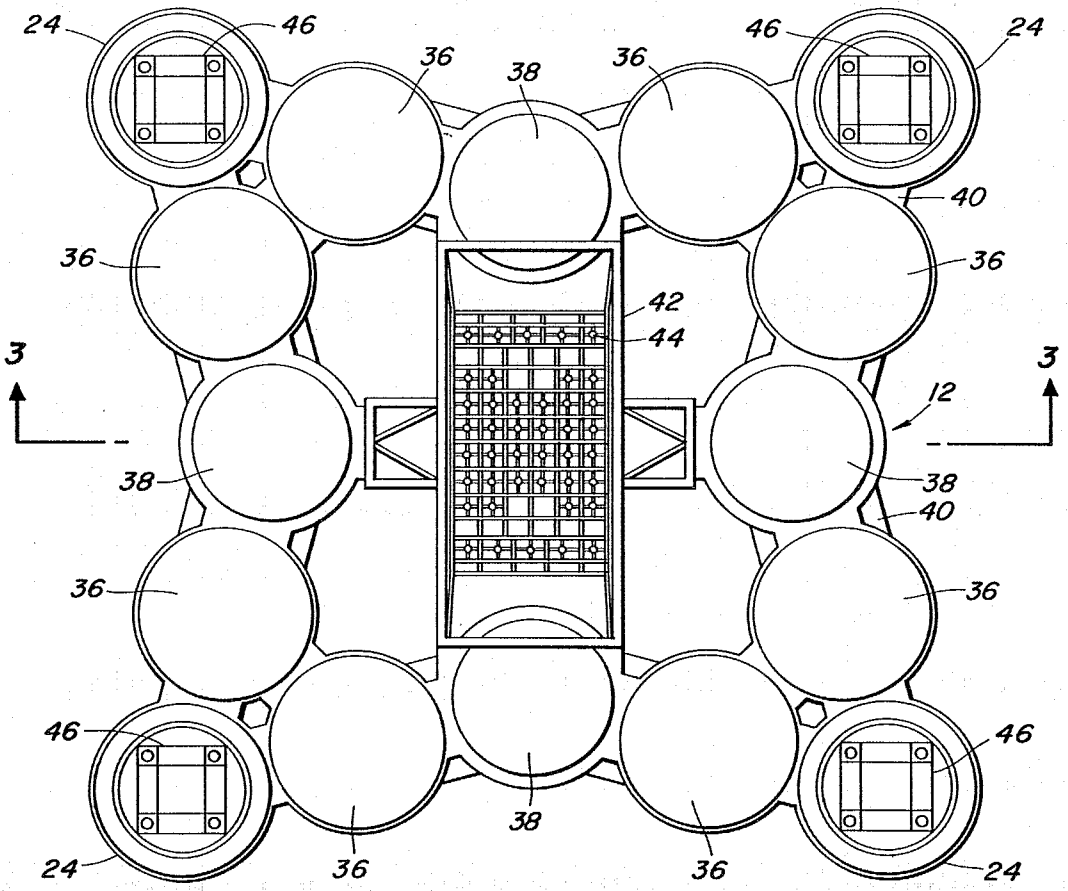
FIG. 2 is a plan view of the gravity base well template.
Figure 3:
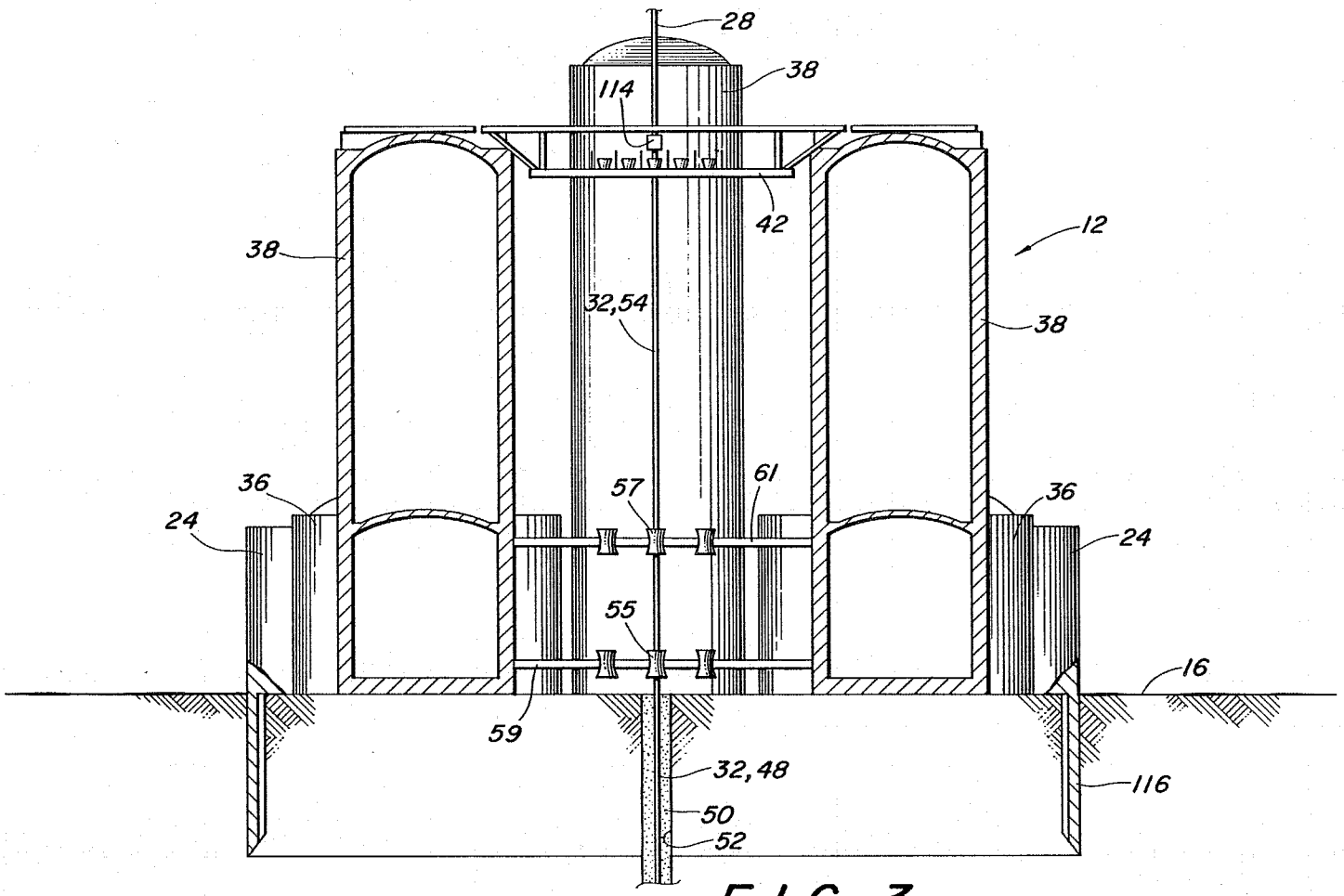
FIG. 3 is a partly sectioned elevation view of the gravity base well template of FIG. 2, taken along lines 3—3.

FIGS. 2 and 3 are plan and elevation/section views, respectively, of the gravity base template 12. The particular form of gravity base template shown in FIGS. 2 and 3 is described in detail in pending U.S patent application Ser. No. 840,235, filed Mar. 17, 1986, which is now U.S. Pat. No. 4,669,916, for UNITIZED TLP ANCHOR TEMPLATE WITH ELEVATED WELL TEMPLATE of Charles N. White and Andrew F. Hunter, and assigned to the assignee of the present invention. The details of construction of the template 12 as set forth in Application Ser. No. 840,235 are incorporated herein by reference.

The template 12 is primarily constructed from reinforced concrete, and as seen in FIG. 2, includes the four corner columns 24, eight small storage tanks 36, four larger storage tanks 38, interconnecting web portions such as 40, and a structural steel grid work 42 defining a plurality of well openings such as 44 therein.

The concrete portion of the template 12 includes a skirt piling 116 which extends downward around the outer perimeter of template 12 and penetrates the ocean floor 16 upon initial placement of the gravity base well template 12 on the ocean floor 16.

On the top of each of the corner columns 24 is an anchor template 46 to which the tethers 14 are attached.

FIG. 3 is a schematic elevation section view of the gravity base well template 12 of FIG. 2 taken along line 3—3 of FIG. 2.

In FIG. 3, one of the well casings 32 is shown, having its lower portion 48 cemented in place at 50 within a well bore 52. An upper portion 54 of casing 32 extends upward from the well bore 52 above the ocean floor 16 to the structural grid portion 42 of gravity base well template 12.

The upper portion 54 of casing 32 extends through lower and intermediate loose-fitting conductor guides 55 and 57, respectively, which are supported by frame members 59 and 61, respectively, of template 12. The guides 55 and 57 and frame members 59 and 61 are shown in a schematic fashion in FIG. 3.

Figure 4:
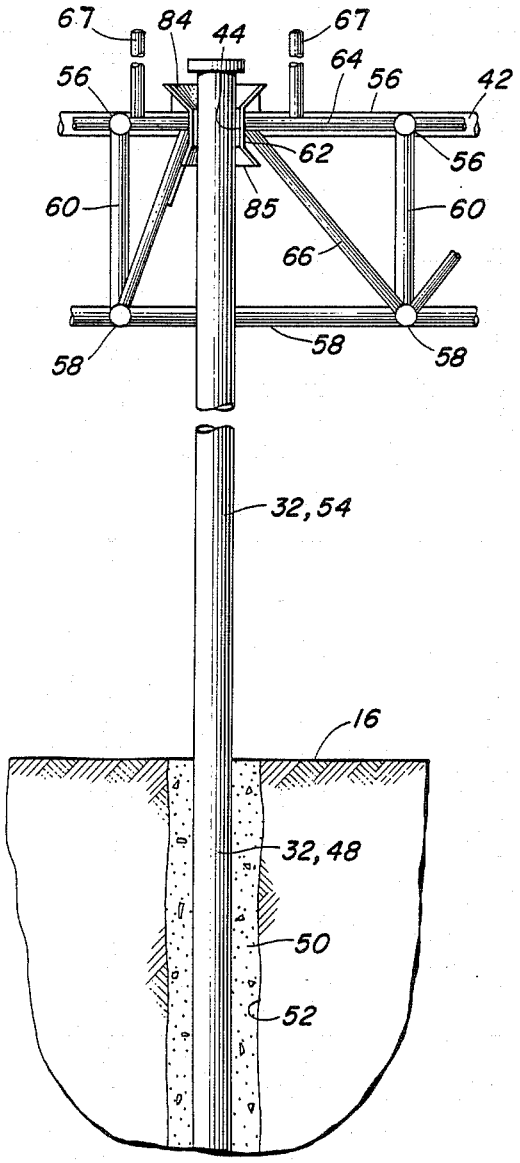
FIG. 4 is an enlarged schematic elevation view of a segment of the gravity base well template with an upper portion of a well casing received therein. The lower portion of the well casing is received in and cemented in place within a well bore extending into the ocean floor.

FIG. 4 is an enlarged elevation sectioned schematic view somewhat similar to FIG. 3, which shows in greater detail the construction of the grid work 42 of template 12, and the manner in which the upper portion 54 of casing 32 is received therein.

The grid work 42 includes a plurality of upper and lower horizontal members 56 and 58, respectively, connected by vertical members 60.

The well opening 44 is defined within a cylindrical template housing 62 which is supported from the upper and lower horizontal members 56 and 58 by smaller horizontal and diagonal structural members 64 and 66, respectively.

Each casing housing such as 62 is located in the center of four guide posts such as 67 to which are connected guide lines (not shown) for use in guiding tubular members such as the casing 32 when they are lowered from the TLP 10 to the template 12.

Figure 5:
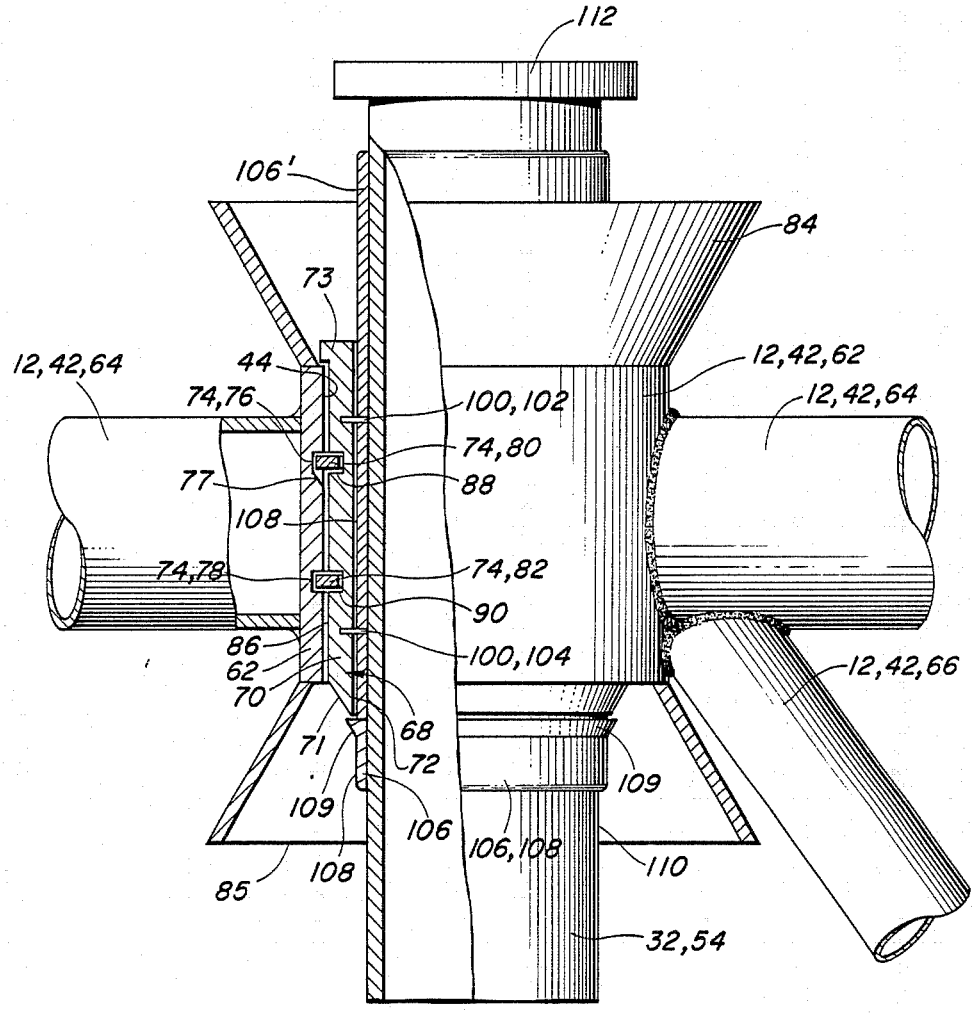
FIG. 5 is an elevation partly sectioned view of the upper end of the casing as received in the well template, showing the details of construction of the casing guide of the present invention.

FIG. 5 is a still further enlarged section elevation view of those portions of the grid work 42 of template 12 immediately surrounding one of the template housings 62, along with the upper end of casing 32 and the apparatus of the present invention providing for connection between the casing 32 and the template 12. The well casing 32 typically will be a thirty-inch diameter casing.

A bushing means 68, shown in FIG. 5, is operably associated with the template housing 62 of template 12 and the casing 32, for permitting relative vertical movement between the template 12 and the casing 32 and for preventing relative lateral movement between the template 12 and the casing 32 at well opening 44.

The bushing means 68 includes a cylindrical bushing member 70 having a cylindrical inner bushing bore 72 within which the casing 32 is closely received. The bushing member 70 is preferably constructed from two semicylindrical halves which are connected together about the uppermost section of casing 32. Bushing member 70 is constructed from a material which is compatible cathodically with the material of the template 12.

The bushing member 70 has a tapered lower end 71 to avoid hanging up of the bushing member 70 as it is inserted downward into template housing 62. Bushing member 70 also has a radially outward extending annular lip 73 at its upper end.

Bushing means 68 further includes a latch means 74 operably associated with the bushing member 70 and with the well opening 44 of template 12, for latching the bushing member 70 into a fixed position within the well opening 44 upon insertion of the casing 32 and bushing means 68 downwardly into the well opening 44 of template 12.

The well opening 44 is defined by a cylindrical housing bore 44 of template housing 62.

The latch means 74 includes upper and lower annular latching grooves 76 and 78, respectively, defined in the well opening/housing bore 44.

Latch means 74 further includes upper and lower radially outwardly biased locking means 80 and 82, respectively, connected to the bushing member 70 and extending radially outward from the bushing member 70 for receipt in the upper and lower latching grooves 76 and 78, respectively, of the well opening/housing bore 44 of housing 62 of well template 12.

Upper groove 76 is shown as having a tapered lower annular surface 77 for allowing lower locking means 82 to pass downward past upper groove 76.

The well template 12 further includes an upwardly open conical guide means 84 concentrically disposed about the well opening/housing bore 44 above the well opening/housing bore 44. A downwardly open conical guide means 85 extends downward below well opening/housing bore 44 to prevent hanging up of bits, underreamers and the like which may be passed upward through well opening/housing bore 44.

The bushing member 70 has a cylindrical outer surface 86 closely received in the well opening/housing bore 44 of template housing 62.

The upper and lower locking means 80 and 82 shown in FIG. 5 may be expandable snap rings which are carried by upper and lower grooves 88 and 90 defined in outer surface 86 of bushing member 70.

A releasable connecting means 100 is operably associated with the casing 32 and bushing member 70 for initially limiting vertical movement of the bushing member 70 relative to the casing 32 until the bushing member 70 is latched into the fixed position illustrated in FIG. 5 within the well opening/housing bore 44 of well template 62. The releasable connecting means 100 preferably is a means for initially preventing any substantial vertical movement of the bushing member 70 relative to the casing 32, but could also be designed to allow some limited movement of the bushing member 70 relative to the casing 32.

In the preferred embodiment illustrated in FIG. 5, the releasable connecting means 100 includes a plurality of shear pins such as 102 and 104 connected between the casing 32 and the bushing member 70.

The casing 32 includes a sleeve 106' fixedly connected thereto and sleeve 106 snugly but slidably positioned therebelow, sleeves 106 and 106' together defining outer cylindrical surface 108. The sleeve 106' is snugly received in the inner bushing bore 72. Sleeve 106' is stiff enough to prevent any substantial lateral movement of the casing 32 relative to the bushing member 70. The snug fit of sleeve 106' in bore 72 does, however, permit vertical sliding motion of casing 32 and the sleeve 106' thereof relative to bushing member 70.

The sleeve 106' is preferably made from metal or a hard elastomeric-composite material which is shrink-fitted or bonded the casing 32, while sleeve 106 which is made of the same material is simply fit snugly upon casing 32. One purpose of sleeves 106' and 106 is to provide a more concentric outer surface 108 than is present on typical casing which may be slightly out-of-round.

The sleeve 106 includes a radially outwardly extending tapered lip 109, located below tapered lower end 71 of bushing member 70, to aid in preventing hanging up of bushing member 70 as it is inserted downward into template housing 62 and, more importantly, to avoid undesired contact by an external member with bushing member 70 that might prematurely shear shear pins 102 and 104.

The shear pins such as 102 and 104 have their radially inner ends contact-welded to an outer surface 110 of casing 32, and extend through sleeve 106' into engagement with blind bored drilled radially into the bushing bore 72 as seen in FIG. 5.

The methods of using the present invention may be generally described as follows.

First, the gravity base well template such as 12 having a well opening 44 defined therein is placed upon the subsea floor 16.

The bushing means 68 is assembled with the well casing 32 which is then lowered from the TLP 10 down through the well opening/housing bore 44 of template 12 until the lower portion 48 of casing 32 is received in the well bore 52.

Upon downward insertion of the casing 32 and bushing means 68 into the well opening/housing bore 44 of template 12, the upper and lower locking means 80 and 82 connectably engage with the upper and lower grooves 76 and 78 defined in well opening/housing bore 44 so that the bushing means 68 is substantially fixed relative to the template 12 for preventing lateral movement of the casing 32 relative to the template 12 at the well opening/housing bore 44.

During the period of time that the casing 32 and bushing means 68 are being lowered into position, the bushing means 68 is held fixed to the casing 32 by the releasable connecting means 100.

Once the bushing means 68 is connectably engaged with the template 12 as illustrated in FIG. 5, the releasable connecting means 100 may be released by applying a vertical load to the casing 12 thus shearing the shear pins 102 and 104 and allowing the casing 12 with its elastomeric sleeve 106' to slide vertically within the bushing bore 72, slidable sleeve 106 can slip down casing 32 as necessary when contacted by bushing 70.

Then the lower portion 48 of casing 32 is fixed in the well bore 52 by cementing as indicated at 50.

During the operational life of the well template 12, it will tend to gradually settle into the ocean floor. This settling in some cases may be up to approximately ten inches over the operating life of the template 12.

With a gravity base well template 12 line that illustrated in FIG. 3, the upper unsupported portion 54 of casing 32 extending from the ocean floor 16 to the grid work 42 of template 123 may have a length on the order of thirty to fifty meters. Accordingly, if the gravity base template 12 were fixedly attached to the casing 32 at the well opening/housing bore 44, the compressive loads applied to the unsupported upper portion 54 of casing 32 during settling of the gravity base well template 12 would present a real danger of buckling the upper portion 54 of casing 32.

The bushing means 68 of the present invention, however, allows the gravity base well template 12 to settle downward into the ocean floor relative to the casing 32 without imposing substantial compressive loads upon the upper portion 54 of casing 32 thus eliminating the danger of buckling of the upper portion 54 of the casing 32.

At the same time, however, it is necessary that a firm lateral support be provided to the casing 32 at the well opening/housing bore 44.

As schematically illustrated in FIG. 3, an upper end 112 (see FIG. 5) of casing 32 is connected to one of the production risers 28 by a connector 114.

As will be appreciated by those skilled in the art, the production riser 28 is subject to substantial lateral forces from currents and from movement of the TLP. If the casing 32 is not firmly supported against alteral movement at the well opening/housing bore 44 defined through the grid work 42 of template 12, the dynamic response of the production riser 28 could result in potentially damaging impacts between the casing 32 and the template 42. Additionally, dynamic forces could be transmitted to the upper portion 54 of the casing 32 and to other tubular members contained therein which could over a long period of time lead to fatigue failure of these items.

The bushing means 68 of the present invention provides the necessary lateral support, while at the same time allowing the gravity base well template 12 to settle into the ocean floor without imposing dangerous compressive loads upon the unsupported upper portion 54 of casing 32.

Thus it is seen that the apparatus and methods of the present invention readily achieve the ends and advantages mentioned as well as those inherent therein. While certain preferred embodiments of the invention have been illustrated for the purposes of the present disclosure, numerous changes in the arrangement and construction of parts may be made by those skilled in the art which changes are encompassed within the scope and spirit of the present invention as defined by the appended claims.

What is claimed is:

1. A casing guide apparatus, comprising:

a well template having a template housing with a housing bore therethrough defining a well opening;

a cylindrical well casing received through said well opening; and bushing means, operably associated with said template and said casing, for permitting relative vertical movement between said template and said casing and for preventing relative lateral movement between said template and said casing at said well opening wherein said bushing means includes:

a cylindrical bushing member having a cylindrical inner bushing bore within which said casing is closely received; and latch means, operably associated with said bushing member and said well opening of said template, for latching said bushing member into a fixed position within said well opening upon insertion of said casing and said bushing means downwardly into said well opening of said template said latch means including:

an annular latching groove defined in said housing bore; and radially outwardly biased locking means, connected to said bushing member and extending radially outwardly from said bushing member, for receipt in said latching groove of said housing bore of said template.

2. The apparatus of claim 1, wherein:

said template is a gravity base template which will gradually settle into a floor of a body of water during its operating life;

said casing has a lower portion thereof cemented within said floor of said body of water, and said casing has an upper portion thereof extending above said floor and through said well opening of said template; and said bushing means is further characterized as a means for permitting said gravity base template to settle into said floor relative to said casing without imposing substantial compressive loads on said upper portion of said casing, thus eliminating a danger of buckling of said upper portion of said casing upon settling of said gravity base template.

3. The apparatus of claim 1, wherein:

said template further includes upwardly open conical guide means concentrically disposed about said housing bore above said housing bore.

4. The apparatus of claim 1, wherein:

said bushing member has a cylindrical outer surface closely received in said housing bore of said template housing.

5. The apparatus of claim 1, further comprising:

releasable connecting means, operably associated with said casing and said bushing member, for initially limiting vertical movement of said bushing member relative to said casing until said bushing member is latched into said fixed position thereof within said well opening of said template.

6. The apparatus of claim 5, wherein:

said releasable connecting means is further characterized as a means for initially preventing any substantial vertical movement of said bushing member relative to said casing.

7. The apparatus of claim 6, wherein:

said releasable connecting means includes a plurality of shear pins connected between said casing and said bushing member.

8. The apparatus of claim 1, wherein:

said casing includes a sleeve fixedly connected thereto and defining an outer cylindrical surface thereof, said sleeve being snugly received in said inner bushing bore so as to prevent any substantial lateral movement of said casing relative to said bushing member and so as to permit vertical sliding motion of said casing and said sleeve relative to said bushing member.

9. A method of constructing an underwater well, said method comprising the steps of:

(a) placing a well template having a well opening defined therein on a floor of a body of water;

(b) assembling a bushing means with a well casing;

(c) lowering said well casing downward through said well opening of said template until a lower portion of said casing is received in a well bore;

(d) connectably engaging said bushing means with said well template so that said bushing means is substantially fixed relative to said template for preventing lateral movement of said casing relative to said template at said well opening;

(e) fixing said lower portion of said casing into said well bore; and (f) allowing said bushing means to slide downward relative to said casing as said well template settles into said floor, thus eliminating a danger of buckling of an upper portion of said casing upon settling of said well template.

10. The method of claim 9, wherein:

step (b) is further characterized as releasably connecting said bushing means and said casing and thereby initially limiting vertical movement of said bushing means relative to said casing; and said method further comprises a step, after step (d), of releasing said bushing means so that said bushing means is free to slide vertically along said casing.

11. The method of claim 10, wherein:

step (b) is further characterized as initially preventing vertical movement of said bushing means relative to said casing.

12. The method of claim 11, wherein:

step (b) is further characterized as frangibly connecting said bushing means and said casing with a plurality of shear pins; and said releasing step is further characterized as applying a vertical force to said casing to shear said shear pins.

13. The method of claim 10, wherein:

said releasing step is performed prior to step (e).

14. The method of claim 9, wherein:

said step (e) is further characterized as cementing said lower portion of said casing into said well bore.

* * * * *